US005694921A

United States Patent [19]

Pokhis

[11] Patent Number: 5,694,921

[45] Date of Patent: Dec. 9, 1997

[54] PROTECTIVE JACKET

[76] Inventor: Naum' Pokhis, 1132 S. Doheny Dr., #303, Los Angeles, Calif. 90035

[21] Appl. No.: 695,230

[22] Filed: Aug. 7, 1996

[51] Int. Cl.[6] ..... A62B 7/10; A41D 1/02

[52] U.S. Cl. ..... 128/202.13; 128/202.19; 2/94; 2/97

[58] Field of Search ..... 2/93, 94, 97, 108; 128/202.13, 202.19, 204.17, 205.27, 205.29, 206.12

[56] References Cited

U.S. PATENT DOCUMENTS

| | | | |
|---|---|---|---|
| 334,360 | 1/1886 | Elliot | 128/202.19 X |
| 789,145 | 5/1905 | Derx | 128/202.19 |
| 1,009,083 | 11/1911 | McNamee | 128/202.19 |
| 4,090,509 | 5/1978 | Smith | 128/202.19 |
| 4,331,141 | 5/1982 | Pokhis | 128/204.28 |
| 4,768,235 | 9/1988 | Webster | 2/205 |
| 5,014,355 | 5/1991 | Vollenweider, II | 2/79 |
| 5,063,923 | 11/1991 | Peroni | 128/201.13 |
| 5,265,592 | 11/1993 | Beaussant | 128/201.24 |

FOREIGN PATENT DOCUMENTS

| | | | |
|---|---|---|---|
| 630 115 | 5/1936 | Germany | 128/202.19 |
| 1 001 897 | 1/1957 | Germany | 128/202.19 |
| 1 077 066 | 3/1960 | Germany | 128/202.19 |
| 5-177004 | 7/1993 | Japan | 128/202.19 |
| 44257 | 6/1961 | Poland | 128/202.19 |
| 984481 | 1/1983 | U.S.S.R. | 128/204.17 |
| 20296 | of 1890 | United Kingdom | 128/204.17 |

*Primary Examiner*—Vincent Millin
*Assistant Examiner*—Eric P. Raciti
*Attorney, Agent, or Firm*—Ilya Zborovsky

[57] ABSTRACT

A protective jacket, comprises an inner layer and an outer layer composed of an air-impermeable fabric, a layer of a resilient porous material located between the inner and outer layers, and filtering means, the layers being formed so that when the jacket is fitted on a user's chest and upper part of stomach, during inhaling a pressure in an interior increases and air is pressed through the filtering means to be inhaled by the user.

7 Claims, 2 Drawing Sheets

PROTECTIVE JACKET

BACKGROUND OF THE INVENTION

The present invention relates generally to articles of clothing which can contribute to communication of air with the use of filtration for their user and to protect respiration, cover a user's skin and eyes from the action of poisonous substances in an environment, etc.

Articles of the above mentioned general type are known in the art. One of such articles is disclosed in my U.S. Pat. No. 4,331,141. In the construction disclosed in this patent, the filtration of air and its supply into the zone of mouth and nose is performed by means of an electric chamber which is mounted on a user's chest and is activated when chest is expanded during inhaling with the use of a belt and a lever system. While this device performs its intended Functions, it has some disadvantages. The device is arranged in front of the chest and therefore interferes with user's perform of some actions. The belt around the chest presses against the muscles during inhaling, thus causing a certain discomfort. The working value of the chamber is not always sufficient to provide a user with filtered, clean air. When the device operates on the stomach, it is less efficient. It is also difficult to wear normal clothing under the device and over the device.

SUMMARY OF THE INVENTION

Accordingly, it is an object of the present invention to provide a protective jacket which avoids the disadvantages of the prior art.

In keeping with these objects and with others which will become apparent herein after, one feature of the present invention resides, briefly stated, in a protective jacket which has an inner end and an outer layer composed of air-impermeable material with a layer resilient porous material, and the jacket is hermetically closed, so that a hermetic seam extends along the back area and subdivides it into a right and left halves.

When the device is designed in accordance with the present invention it eliminates the disadvantages of prior art.

Aspirating valves are mounted in a lower outer side of each half of the jacket. The jacket is closed by a zipper which has one part on one side and several parallel parts on the other side. In order to improve protection of the user from poisonous substances in the air, it is possible to use a plastic bag which is worn on a user's head so that its rubber edge engages in a special depression of a standing collar of the jacket.

The novel features which are considered as characteristic for the present invention are set forth in particular in the appended claims. The invention itself, however, both as to its construction and its method of operation, together with additional objects and advantages thereof, will be best understood from the following specification and description of specific embodiments when read in connection with the accompanying drawing.

DESCRIPTION OF PREFERRED EMBODIMENTS

Figure 1:
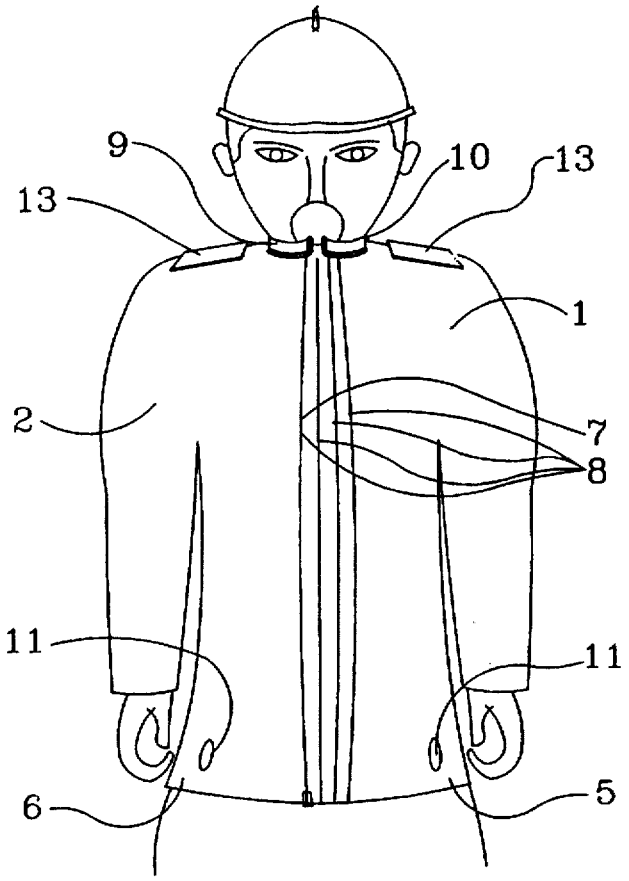
FIG. 1 is a front view of a protective jacket in a working condition in accordance With the present invention.
Figure 2:
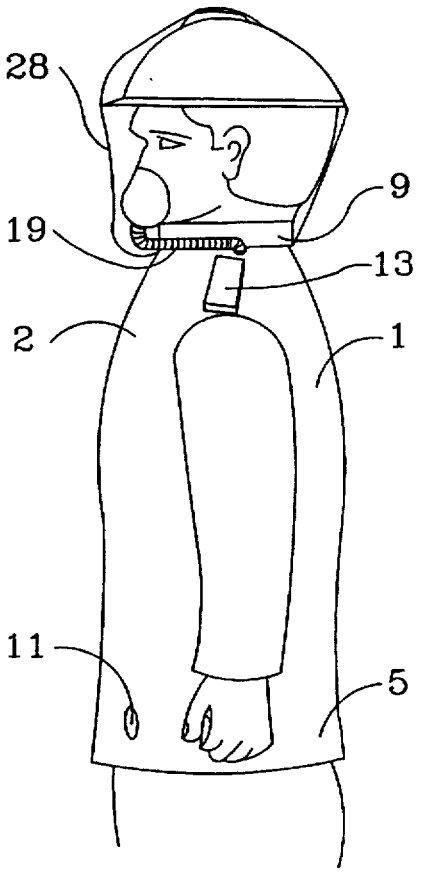
FIG. 2 is a side view of the inventive protective jacket in the working position.
Figure 3:
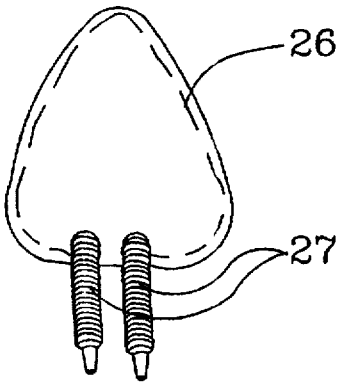
FIG. 3 is a view showing a small mask with bendable pipes of the inventive protective jacket.
Figure 4:
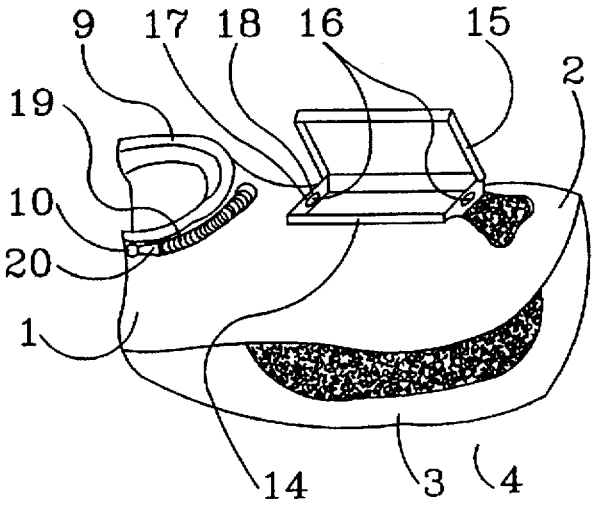
FIG. 4 is a view showing a partial cross-section of the upper half of the inventive protective jacket.
Figure 5:
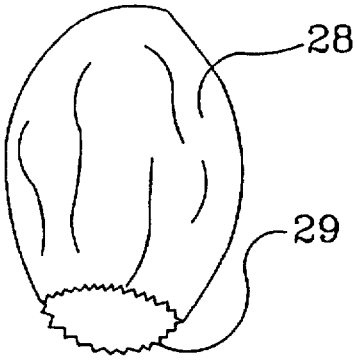
FIG. 5 is a view showing a plastic bag for the inventive protective jacket.
Figure 6:
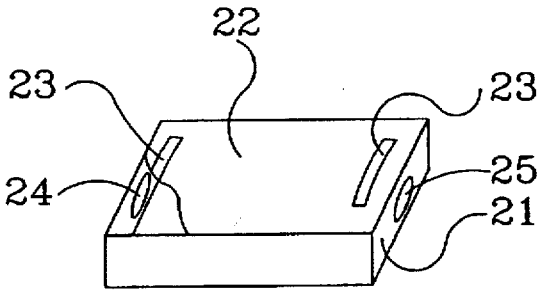
FIG. 6 is a view showing the filter of the inventive protective jacket.

A protective jacket in accordance with the present invention has a jacket part which is identified as a whole with reference numeral 1. It is composed of an outer fabric layer 2 and a lower air-impermeable stretchable fabric layer 3 with a porous resilient material layer 4 there between. It is hermetically closed along its contour, for example by heat welding. At the rear, the jacket has a longitudinal seam which subdivides it into two symmetrical, insulated halves including a left half 5 and a right half 6. At the front side, it is closed by one half zipper 7 and several half-zippers 8.

The jacket has a standing collar 9 with a depression 10. Suction valve 11 is mounted in the lower side part of each half of the jacket. Symmetrical shoulder boxes 13 are arranged in the upper parts in each half of the jacket and composed of a box 14 and an openable hermetic cover 15. The end walls of each box 14 are provided with two round openings 16 surrounded by a ceiling rubber ring 17. An aspirating valve 18 is arranged in an opening 16 located closer to a standing collar 9. The aspirating valve merges into a bellows-type neck pipe 19 which ends with a socket 20.

Filters 21 are arranged inside each shoulder box 13. They form a box with a hermetic cover 22, catches 23 and end openings 24 and 25 forming a hermetic structure due to the sealing rings 17. The jacket further has a mask 26 provided in a lower part with two bendable pipes 27 insertable into the sockets 20.

The device operates in the following manner:

When it is necessary to protect the respiration organs from poisonous components in the air, corresponding filters 21 are selected, the covers 15 are opened and they are placed into the shoulder boxes 13 with subsequent closure of the covers. When a user puts a jacket 1 on and closes it around his or her chest and upper side of stomach by zippers 7 and 8 so as to provide firm embracing of the body, so that air can blow from the sockets 20 during inhaling. Since the respiration can be chest respiration and stomach respiration, it is important that jacket 1 tightly embraces the chest and upper side of the stomach. Then the user takes the mask 26 and inserts the bending pipes 27 into the sockets 20 and then bends the pipes so that the mask is located as close as possible to the face to close the mouth and nose of the user. When the jacket is properly placed on user's body, and the user inhales his or her chest and upper part of the stomach increase in volume, and this volume increase applies pressure onto the inner fabric layer 3 which is stretchable, so that the inner fabric layer 3 stretches and the pressure is transferred to the porous receded material layer 4 which presses against the outer fabric 2. Since the jacket tightly embraces the user's body and the outer fabric layer 2 does not stretch, the resilient plastic material layer 4 is compressed, and pressure in the jacket 1 is increased so that the aspiration valves 11 and 12 are closed and air flows through the opening 16 and the filters 21. When the air flows through the filters 21 and is cleaned by the filters, the air opens the valves 18 and through the neck pipes 19, sockets 20 and bending pipes 27 flows under the mask 26 and thereafter through the nose and mouth into the user's lungs. During exhaling, the volume of chest and the upper part of stomach is reduced. As a result, the resilient porous material 14 increases in volume, the pressure inside the jacket 1 is reduced, the aspirating valves 11 are opened and the outer air fills the inner space of the jacket 1 between the outer fabric layer 2 and the inner fabric layer 3. Then the respiration cycle is repeated again.

If the surrounding air is highly air is highly toxic, in addition to the mask 26 a transparent plastic bag 28 is placed on the user's head so that its rubber edge 29 engages in the depression 10 of the standing collar 9. After several inhales, the cleaned air fills the plastic bag 28 through the bellows-type neck pipes 19, which allows a circular vision and confirms a normal operation of the jacket. A small pressure of air is generated inside the plastic bag 28, and an air excess discharges through untightness along the standing collar 9, and at the same time the escaping partially spent air protects the user from penetration of outside contaminated air. If one half of the jacket 1 is damaged, then inhaling of filtered air can be performed by only one non-damaged half. If the pressure in the plastic bag 28 is reduced and it deflates, it is necessary to press the jacket with an elbow of the corresponding arm rhythmically, and the pressure is increased again.

In the event the substance in the filter 21 no longer performs its function or if air contains substances or viruses which are not filtered out by the filter, the filtering material can be removed from the filter 21 and special filters can be introduced into the shoulder boxes. If it is necessary to use the filters for protection of perspiration it suffices to open the zipper 7 and 8 or close the jacket so as to provide a looser position of the jacket without tight embracing of the body, the jacket can be used as a normal article of clothing.

It will be understood that each of the elements described above, or two or more together, may also find a useful application in other types of construction differing from the types described above.

While the invention has been illustrated and described as embodied in a protective jacket, it is not intended to be limited to the details shown, since various modifications max, be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in particular in the appended claims:

1. A protective respiratory filtering device comprising: a jacket having an inner layer and an outer layer composed of an air-impermeable fabric; a layer of resilient porous material located between said inner and outer layers; and means for filtering air in fluid communication with said resilient porous material, and means for, when said jacket is tightly worn by a user over a user's chest and stomach, creating during inhalation by a user a pressure between the inner and outer layers creating an airflow through said resilient porous material and said means for filtering air.

2. A protective respiratory filtering device as set forth in claim 1 further comprising: a mask, and a flexible pipe connecting said means for filtering air and said mask so that the mask is in fluid communication with the means for filtering air.

3. A protective respiratory filtering device as set forth in claim 1 further comprising: a plastic bag fittable on a user's head, and having an opening defining a collar selectively attachable to said jacket at a neck region; the collar comprising means for allowing, in use, excess pressure to vent to the ambient and preventing penetration of ambient air.

4. A protective respiratory filtering device as set forth in claim 1 further comprising: means for adjusting the jacket to the body sizes of varying users.

5. A protective respiratory filtering device as set forth in claim 4, wherein said means for adjusting is further for allowing said jacket to be loosely worn as normal clothing.

6. A protective respiratory filtering device as set forth in claim 1, wherein said means for filtering air further comprises a plurality of selectably interchangeable filters each configured for a particular contaminant, whereby a selected configuration of said plurality of interchangeable filters may be employed.

7. A protective respiratory filtering device as set forth in claim 6 wherein said filtering means further comprises a box mounted on each shoulder region of said jacket, each of said boxes accommodating one of said selectably interchangeable filters.

* * * * *